United States Patent [19]

Gladish

[11] 4,185,399

[45] Jan. 29, 1980

[54] DOCTOR BLADE, DRYING OR SEALING ASSEMBLY

[75] Inventor: Herbert E. Gladish, Ottawa, Canada

[73] Assignee: E.B. Eddy Forest Products, Ltd., Ottawa, Canada

[21] Appl. No.: 947,436

[22] Filed: Oct. 2, 1978

[51] Int. Cl.[2] ..... F26B 11/02

[52] U.S. Cl. ..... 34/120; 34/114; 34/122; 15/256.51; 15/306 A; 162/281; 162/272

[58] Field of Search ..... 15/256.5, 256.51, 306; 34/117, 114, 120, 122; 68/270, 128; 162/281, 272, 282, 306; 100/174

[56] References Cited

U.S. PATENT DOCUMENTS

| | | | |
|---|---|---|---|
| 1,595,478 | 8/1926 | Minton | 34/117 X |
| 1,918,207 | 7/1933 | Grobstein et al. | 15/306 A X |
| 2,352,220 | 6/1944 | Overton | 34/120 X |
| 3,077,675 | 2/1963 | Dickens | 34/122 |
| 3,085,347 | 4/1963 | Justus | 34/122 X |
| 3,750,306 | 8/1973 | Rodwin et al. | 34/122 X |
| 4,019,953 | 4/1977 | Mystrom | 162/272 |
| 4,124,941 | 11/1978 | Birke et al. | 34/114 X |

FOREIGN PATENT DOCUMENTS

| | | | |
|---|---|---|---|
| 728915 | 3/1966 | Canada | 162/281 |
| 511551 | 11/1930 | Fed. Rep. of Germany | 162/272 |
| 569809 | 2/1933 | Fed. Rep. of Germany | 15/256.51 |
| 674969 | 4/1939 | Fed. Rep. of Germany | 34/122 |

*Primary Examiner*—William F. O'Dea
*Assistant Examiner*—Harold Joyce
*Attorney, Agent, or Firm*—Colton & Stone, Inc.

[57] ABSTRACT

The described apparatus has utility as a doctor on a paper machine, as a drying element in an aircap dryer and as a sealing element in such a dryer. It involves a foot portion having an outer surface generally conforming to the curvature of the cylinder surface on which it is used. It is resiliently supported in close juxtaposition to the cylinder surface so that a gap diminishing in thickness towards one longitudinal edge of the foot portion is provided. At least two rows of nozzles communicate through the foot portion in order to project pressurized air into the gap. Each nozzle is angled relative to three orthogonal planes, one of which is tangent to the cylinder surface at the point where the nozzle axis meets the surface, another of which is parallel to the longitudinal edge of the foot portion. The flow from the nozzles is such as to support the foot portion and to seal the support flow from any disorganized flows. The jetting air will tend to aid in doctoring a paper sheet from the cylinder surface or to dry a paper sheet passing thereunder or to seal an opening from the passage of air therethrough if the opening is defined by a cylindrical surface.

9 Claims, 10 Drawing Figures

DOCTOR BLADE, DRYING OR SEALING ASSEMBLY

The present invention is particularly concerned with the utilization of pressurized fluids in the paper making industry and is particularly useful in drying and doctoring operations.

As is well known paper making in the past was as much an art as it was a science. However, with the high speeds of present day paper making the production of good quality paper can only be enhanced if the paper maker himself is very talented. Computer controls and improved technology are moving to decrease the downtime of the paper machine and to make it more efficient and effective. The paper maker thus is able to devote more of his time to his "art." One of the problem areas which still has a good deal of downtime associated therewith is the creping operation which involves the use of a doctor blade on the Yankee roll in the dryer stage. Experience shows that there is considerable wear both to the Yankee shell and the doctor blade although the doctor blade has more wear associated therewith. Both the blade and the shell have to be reground periodically to bring them back into dimensional congruity. The doctor blade regrinds can be carried out with little machine disruption since they are replaced on the run every 20 to 120 minutes. But the Yankee regrinds are time-consuming, frequent and costly, and, of course, both the doctor blade and the Yankee have structural limits which determine the total amount of material that can be ground off. Since the Yankee roll is pressurized it is understood that as the shell thickness decreases so must the internal pressure and/or the loading. This greatly limits the usefulness of this very costly item, most Yankees now costing over one million dollars to replace.

In many mills the bottleneck for increased speed potential is the dryer section. The dryers, of course, may include the Yankee mentioned above which is steam heated to vaporized moisture from the paper web thereon. In some instances dryer performance is aided by the provision of a peripheral hood which utilizes nozzles and high velocity air jets. These high velocity hot air or gas hoods or caps are placed over standard steam dryers to improve the rate of uniformity of drying. Because there is a boundary layer of moisture upon the web which impedes heat flow to and moisture flow away from the sheet, high expenditures of energy are required in order to obtain the hot gas velocities in the region of 10,000 to 20,000 feet per minute that are needed to decrease the boundary-layer effect. The temperatures of the heated air used in the range of, say 600° F. to 800° F. An attendant problem with hot air caps is, of course, the removal of the vast volumes of high temperature saturated air. The balance between air flowing to the sheet and back pressure involved in removing the mositure and air has always been a design compromise.

It has been known in the past to use doctor blades supported on a film of air. Minton in his Canadian Pat. No. 223,760 issued Apr. 5, 1922 described and claimed such a device but it never enjoyed any commercial success. In the Minton doctor a relatively narrow structure was provided with a passage ending in a port near the end of the toe portion. Air escaped at the port in the form of a jet adjacent a cylinder and the jet would allegedly strip the web from the cylinder. A portion of the fluid under pressure would back up to form a cushion between the toe and the cylinder to preclude contact of the doctor with the cylinder. It is noted in particular that the passage is in a plane perpendicular to the cylinder axis and hence the air jetting from the port will be unstable and would tend to back up on either side of the port and would not be organized. Thus the action of the doctor and of the creped paper resulting from operation thereof would not be consistent and predictable. In addition, no cleaning of the cylinder surfaces either to the front or back of the toe portion would be provided.

The present invention is intended to overcome the problems of the prior art with respect to doctoring and drying. The structure of the present invention is such that it can be used as an air-supported doctor, as an element in a high-velocity hot air dryer and as a sealing element in an air cap type dryer. The present invention utilizes air exitting from a curved surface positioned along the length of a cylinder to support the surface away from the cylinder. The jetting air is angled obliquely relative to the cylinder axis so that its flow is organized and predictable. In addition a portion of the jetting air is used to effectively seal the remainder to the jetting air from escaping in an unwanted and hence inefficient flow pattern.

In its broadest aspects the present invention contemplates apparatus for use in conjunction with a cylinder surface rotatable about an axis. The apparatus comprises a foot portion having an outer surface which substantially conforms to the curvature of the cylinder surface and means for resiliently supporting the apparatus in close juxtaposition to the cylinder surface whereby a gap of thickness diminishing progressively towards one longitudinal edge of the foot portion is formed between the outer surface and the cylinder surface. At least two rows of nozzles communicate through the foot portion to exit therefrom at the outer surface. A source of pressurized fluid is connectable to the nozzles, each of the nozzles being directed obliquely to three orthogonal planes, one of which is parallel to the one edge and another of which is tangent to the outer surface at the juncture of the nozzle axis with the outer surface. Thus, fluid which issues from the nozzles in the row farthest from the one edge will coact with the fluid issuing from adjacent nozzles in the same and adjoining rows to act as a seal to preclude fluid from the remaining nozzles from passing thereby.

The invention will now be described in greater detail and with reference to the drawings wherein.

Figure 4A:
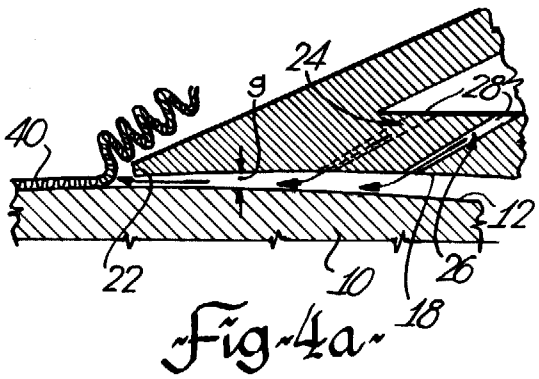
Figure 4:
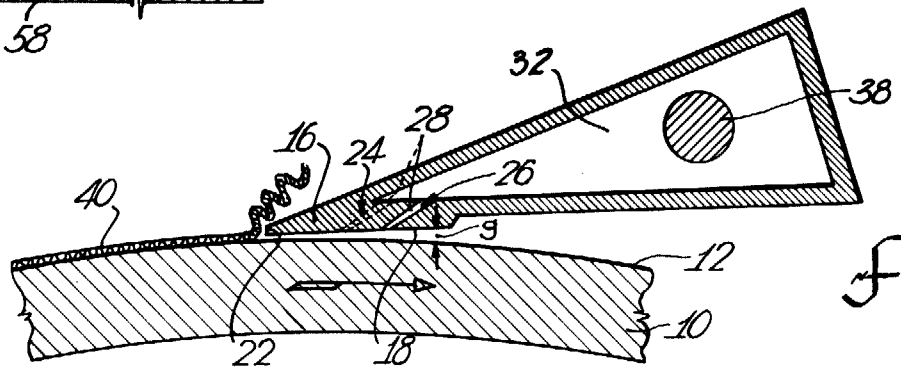

FIGS. 4 and 4*a* show a basic doctoring application of the present invention.

Figure 5:
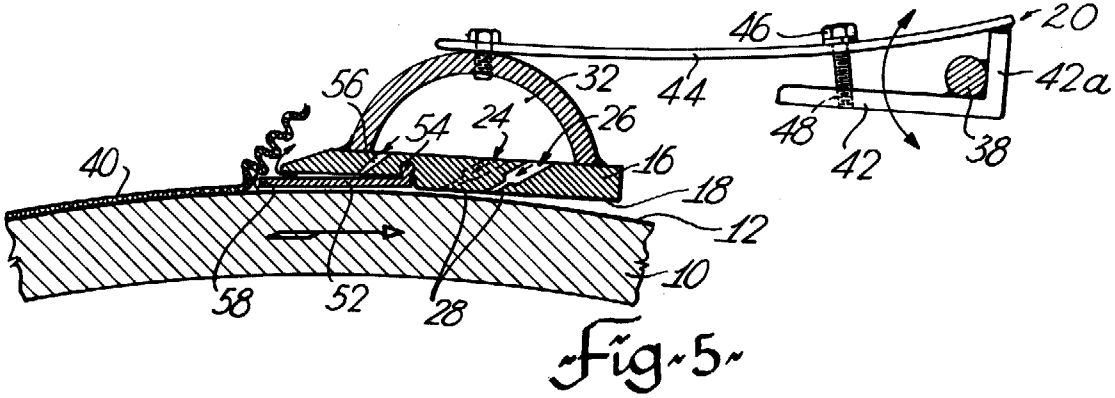
Figure 5A:
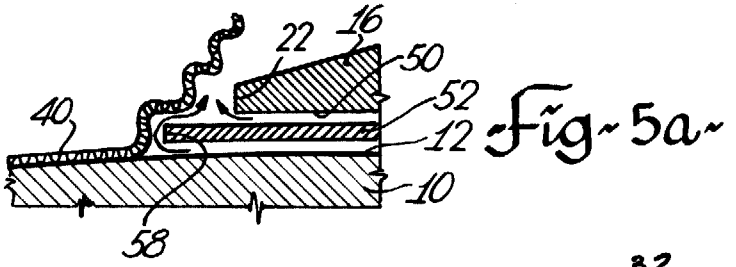

FIGS. 5 and 5*a* show a more sophisticated version of the doctoring application of the present invention.

Figure 7:
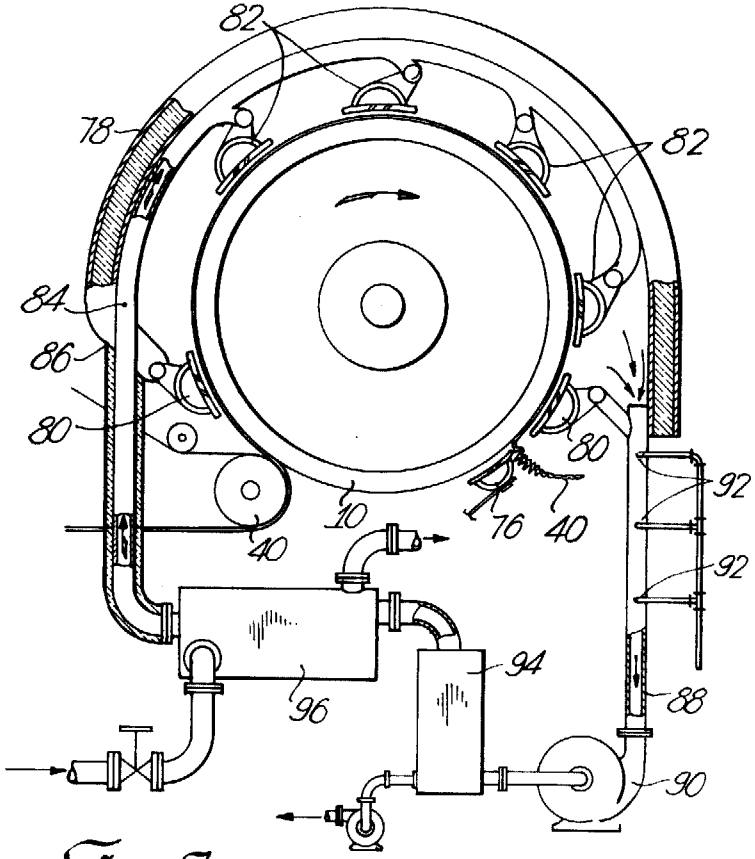
Figure 6:
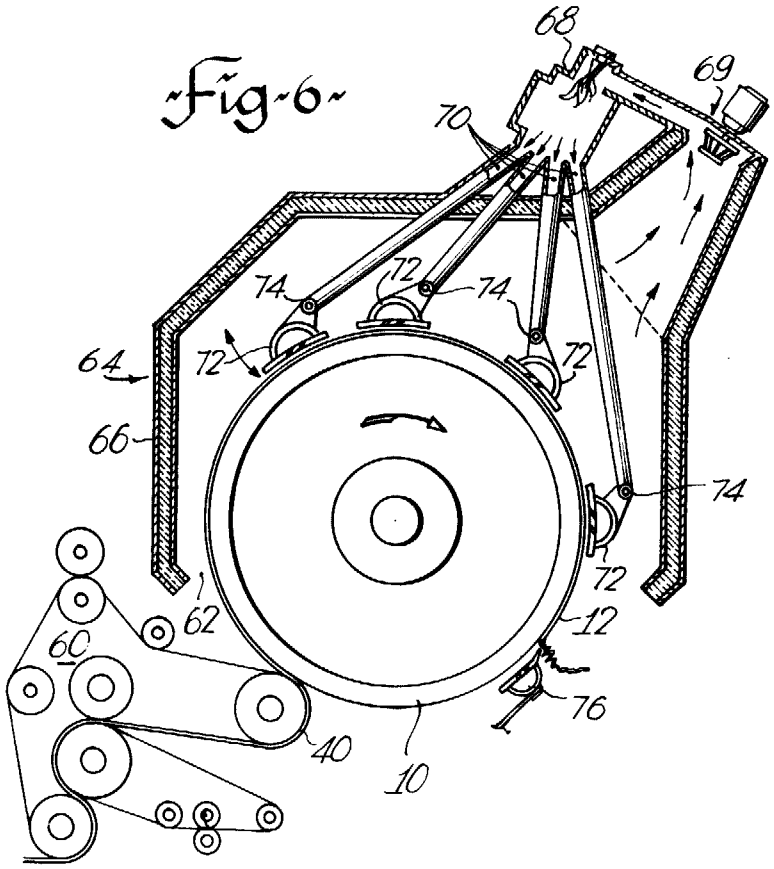
Figure 8:
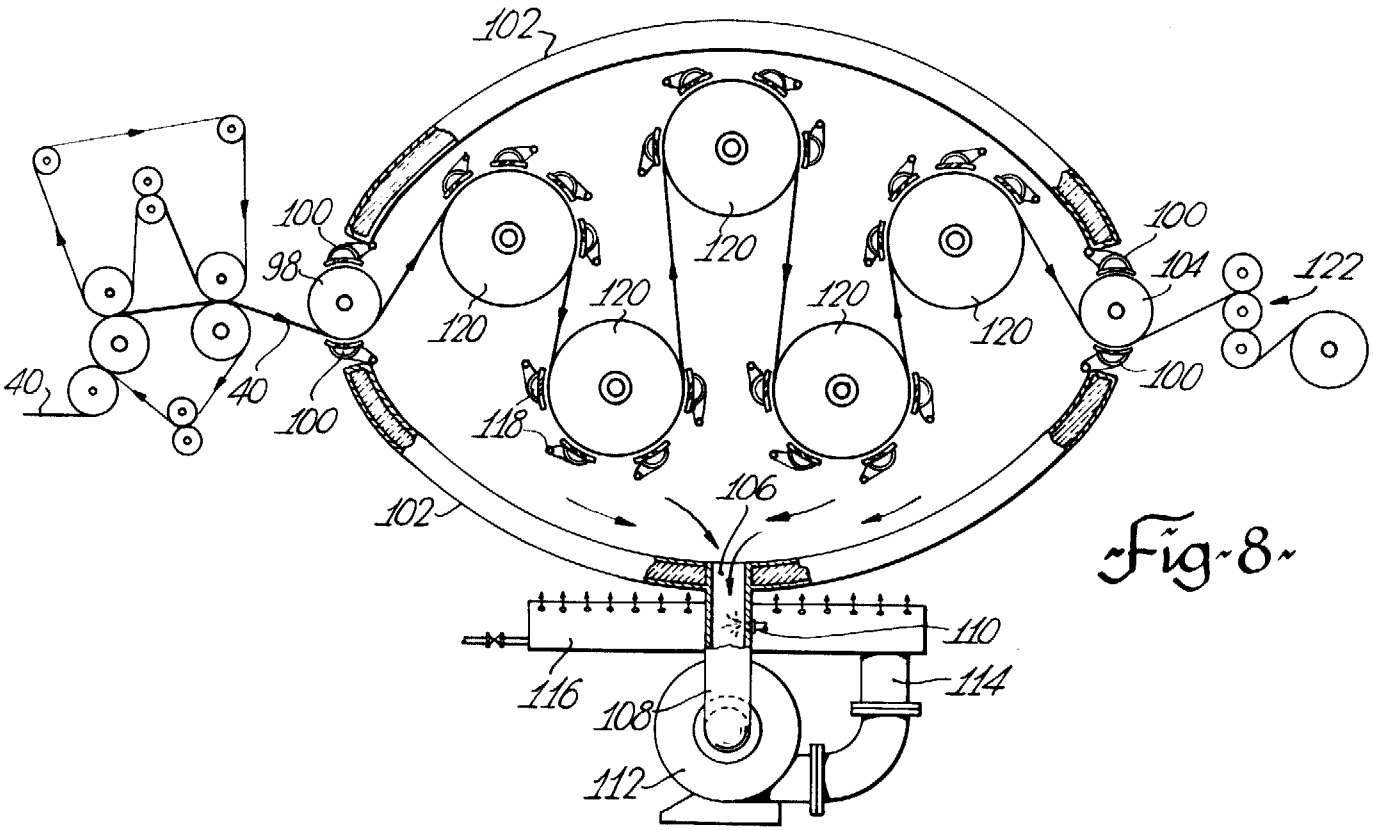

FIGS. 6, 7 and 8 show three separate embodiments of a dryer application of the present invention.

Figures 1, 2, 3:
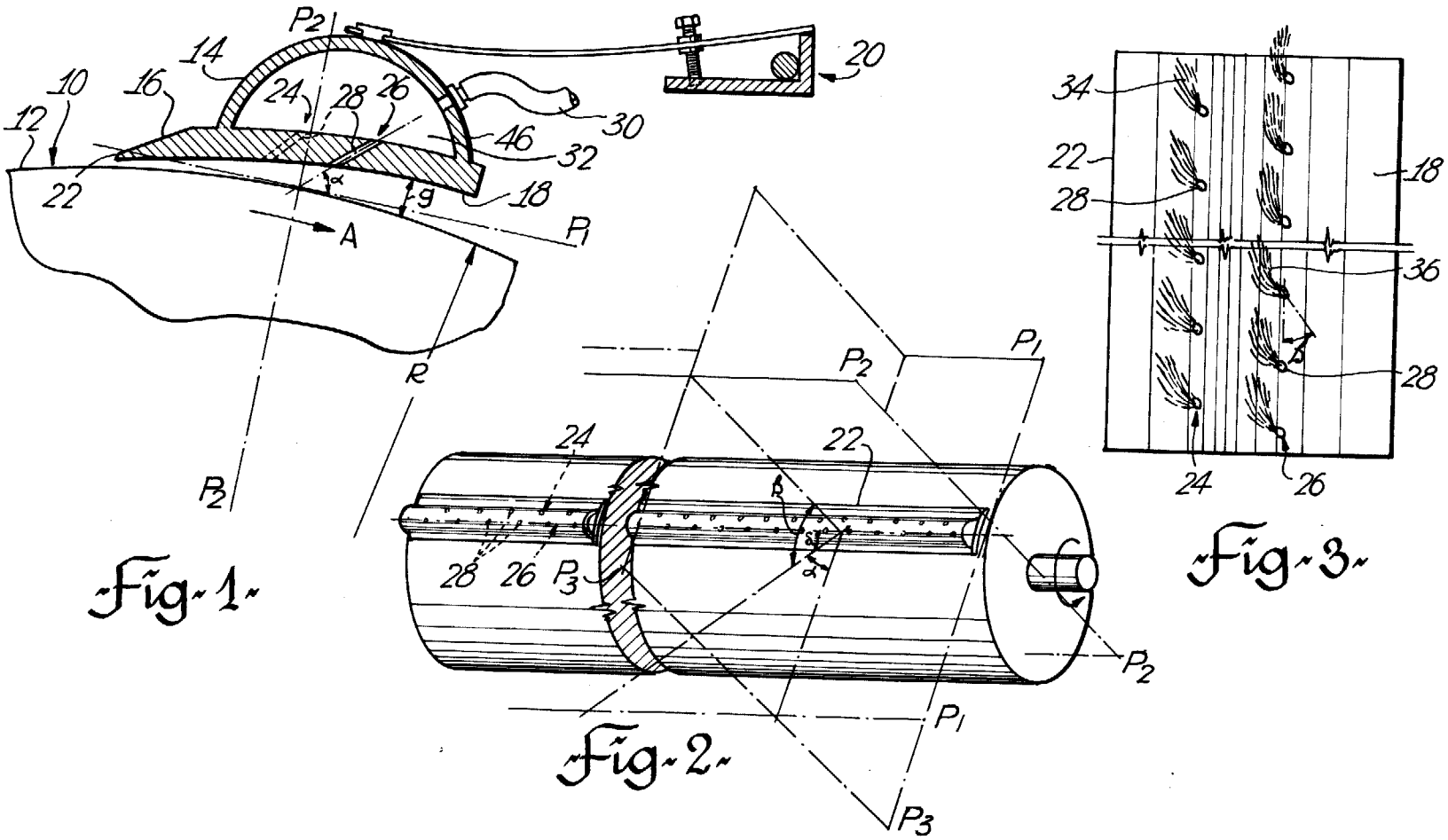
FIG. 1 is a view, generally in cross-section, showing the basic structure of the present invention.
FIG. 2 is a perspective view showing the present invention in place adjacent a cylinder.
FIG. 3 is a view showing the flow pattern of air issuing from the jets of the present invention.

FIGS. 1 and 2 are intended to depict the basic configuration for the present invention, without any particular application such as doctor, dryer, or seal in mind. In some instances in the Figures distances and separation have been exaggerated for effect.

FIG. 1 shows a cylinder 10 of radius R for rotation in the direction of the arrow A. In close juxtaposition to the cylinder surface 12 is the apparatus 14 of the present invention. It is provided with a foot portion 16 having an outer surface 18. Resilient and adjustable means 20, connected to a solid support structure which, under load, maintains the juxtaposition referred to above so that the gap diminishes progressively towards one edge, such as 22, of the foot portion 16. At least two rows 24,26 of nozzles 28 communicate through the foot portion 16 to exit at the outer surface 18 thereof. A course (not shown) of pressurized fluid, such as air, is connectable with the nozzles 28 through hose 30 and plenum 32, the latter formed within housing 34 sealed to foot portion 16. As is seen in FIG. 1 and particularly in FIG. 2 each nozzle is directed obliquely to three orthogonal planes P-1, P-2, P-3. Plane P-1 is parallel to the tangent at the cylinder surface at the juncture of the nozzle axis with the cylinder surface. Plane P-2 is parallel to the edge 22 and, of course, plane P-3 is perpendicular to the planes P-1 and P-2. As seen in FIG. 2 the centerline of a nozzle 28 makes an oblique angle $\alpha$ with plane P-1, an oblique angle $\delta$ with plane P-2 and an oblique angle $\beta$ with plane P-3.

Referring to FIG. 3, air exitting from the nozzles in row 24 as flow 34 will thus issue in such a manner that it tends to be directed towards edge 22 but at an angle oblique thereto. The overall accumulated flow thus has components parallel to the edge 22 as well as perpendicular thereto. The air exitting from the nozzles in row 26 as flow 36 is initially directed in the same general direction as that issuing from nozzles 24. However, the air from nozzles 26 will encounter the air flow from the nozzles in row 24 and this air flow from the nozzles in row 26 will tend to have a greater flow component parallel to the edge 22. In effect this air is turned more towards a parallel flow direction and it acts as a "skirt" or seal along the back portion of the foot 16. This is very advantageous since the sealing air ensures that there is no backward escape of air from the nozzles, even when the cylinder is rotating toward edge 22 and this sealing air also prevents the intrusion of dust and debris into the small gap formed between the surface 18 and the surface 12. Needless to say, the air and the flow thereof operating in the gap g maintains the gap since the structure and its operation is analogous to the structure and operation of an air bearing or a skirtless air cushion.

The flow pattern and the properties thereof as described above can be put to practical use in the paper industry. The structure described above can be used in the paper drying stage to impinge high velocity air at the wet web from very close proximity; the sealing effect can be used to prevent detrimental escape of the drying air from dryer hoods; and the very close juxtaposition of the foot portion to the cylinder surface permits the structure to be used as a doctor for the removal of paper from a rotating cylinder, especially for the creping of the web from a Yankee roll. This is particularly useful in the production of high bulk tissue sheets which are formed and dried to high degrees of dryness with minimum mechanical work being exerted on the paper web. Such work is detrimental to softness and strength of the web but it has been found that differential creping action is of benefit to softness and strength properties.

These various applications of the present invention will be depicted in FIGS. 4 to 8 and described hereinafter. It is noted that most of these Figures show the application of the present invention in essentially schematic or sectional form. It is understood that the configuration is three-dimensional and, for example, that the individual apparatus of the present invention would probably extend along the full length of any cylinder shown although sections of short length can be employed to remove trim from the edges of the dryer cylinder without wear problems.

FIGS. 4 and 4*a* show a very basic concept for use as a doctor for a Yankee, or other, cylinder 10 rotating in the direction of the arrow. The apparatus of the present invention is resiliently mounted on a rotatable shaft 38 which is biased as by a torsion spring, air bag or piston (not shown) to bring the foot portion 16 into close juxtaposition with the cylinder surface 12. A gap g is formed between the surface 12 and the complementary curved outer surface 18 of the foot portion, the gap g diminishing progressively in thickness towards the edge 22 of the foot portion 16. The apparatus is provided with a plenum 32 which is continuously supplied with a pressurized fluid, usually compressed air at various pressures, say 10 to 40 p.s.i. It is understood that doctoring applications require higher loads and extremely close juxtaposition to the web cylinder. The air is permitted to escape from the plenum through nozzles 28 in a pair of parallel rows 24 and 26, the nozzles being oriented as depicted in FIGS. 1 and 2 and having a flow pattern as depicted in FIG. 3. The issuing air forms a thin wedge of fluid between surfaces 12 and 18 as shown in FIG. 4*a*, the thickness of the web diminishing in the direction of projection, that is, towards edge 22. The nozzles are designed so that the air issued therefrom at or near supersonic speeds and exits from the gap with sufficient velocity and force to break the adhesion of the web of paper 40 to the cylinder surface 12. The action of the air-support doctor is such as to impart a creping configuration to the web or to assist, in various degrees, mechanical action of the leading edge of the blade, as shown in FIGS. 4 and 4*a*. It is important to note that the air wedge formed between the surfaces 12 and 18 is sufficient to prevent contact between the doctor and the cylinder surface and the air exitting from the front edge of the foot portion assists in varying the degree of contact between the paper and the doctor. Since there may be somewhat random intrusions of pressurized fluid into the region bounded by the paper, the cylinder surface 12 and the edge 22 the resultant creping action can be considered to be differential along the length of the edge 22 and, as pointed out above, this is a desirable effect. Because of the orientation of the nozzles all of the air is effectively used for support and creping interaction as it all exits in a preferential direction. This flow can be effective in cleaning doctoring surfaces of any fibre or lint buildup. Doctoring is achieved over the full length of the doctor and is readily controlled through variations in air pressure and doctor loading. Because there is no contact between the doctor and the cylinder there will be no wear and no chance of damage to the sheet of paper by worn, chipped or damaged equipment.

It is understood that the resultant radially outward forces generated by the support wedge are counterbalanced by the nozzle unit and support weight together with resilient mounting and loading systems of the apparatus on shaft 38 whereby the gap g is properly maintained at equilibrium.

FIGS. 5 and 5*a* show a somewhat more sophisticated version of the doctor apparatus of FIGS. 4 and 4*a*. As with the previous embodiment the cylinder 10 rotates in the direction of the arrow at its usual speed of roughly 4000 feet per minute, carrying paper web or sheet 40 on its outer curved surface 12. Foot portion 16 is resiliently biased towards cylinder surface 12 by resilient means 20, similar to that shown in FIG. 1, and L-shaped arm 42 is affixed to shaft 38 adjacent and parallel to cylinder 10. A plurality of spaced spring fingers 44 extend from the end of one leg 42*a* of arm 42 and are removably attached to housing 34 of the doctor apparatus. Fingers 44 are spaced along the length of the arm 42 and the doctor apparatus so as to effectively bias the doctor therealong toward the cylinder. Adjusting means 46, shown as a nut passing through finger 44 to be received in a threaded hole 48 in leg 42*b* of arm 44 permits the load on finger 44 and hence the load on the doctor apparatus to be adjusted. In this manner the gap g can be adjusted so that it remains constant or it can be varied as required to account for discrepancies in the surface smoothness or position of cylinder 10.

The foot portion 16 is provided with parallel rows 24 and 26 of nozzles 28 which are oriented and operate as previously described. In addition, however, the surface 18 is stepped, as at 50, in order to accomodate a blade 52 which is removably pivoted to the foot portion as at 54 and which extends outwardly towards and possibly beyond edge 22 along the length of the doctor. A third row of nozzles 56 communicates through foot portion 16 from plenum 32 in order to supply pressurized air to the space between blade 52 and the outer surface of the stepped portion 50 of surface 18 to thereby provide further resilience to the blade support system.

In operation the diminishing gap g is maintained by the air issuing from the nozzles in rows 24 and 26 and most of that air exits from the front edge 58 of blade 52 to break the adhesion of the paper 40 from surface 12 and to assist in giving it its creped effect (see FIG. 5*a*). The air from nozzles 56 exits adjacent edge 22 from between stepped portion 50 and blade 52 and serves to provide a resilient support to the blade as well as to create a source of pressurized air to deflect the creped paper away from the doctor. Thus the chances of difficulties arising from interference by the doctor support with the creped paper is reduced and the creped paper is in a better position to be fed to subsequent operations.

There are many variaties of mounting means for the doctor apparatus, incorporating load adjustment, air feed pressures, etc. In fact it is possible by using an air bag in series with the plenum and the air supply to render the loading automatically appropriate to the pressure conditions present at the gap g. These variations in the mounting means and other variations in the doctor apparatus itself will be readily apparent to someone skilled in the art who is faced with a custom installation of the apparatus for a specific cylinder. Needless to say, all mountings provide a means of quickly releasing built up paperjams or clearing of the drier or feeding of paper by pivoting away from the drier for maximum clearance. Opening of the hood of an air cap dryer for major cleaning of paper build-ups will be by various lifting systems or automatic opening arrangements now in use.

FIG. 6 shows a dryer situation in which the present invention can be utilized to achieve high efficiency drying of paper. A standard press system, depicted by reference number 60 feeds a sheet of partially dried paper 50 to the inlet 62 of a hot gas cap dryer. The standard gas cap system is depicted by reference number 64 and need not be considered in full herein. It suffices to say that in the configuration of FIG. 6 a Yankee or similar dryer cylinder 10 having an outer surface 12 is supported for rotation in the direction of the arrow and it is covered over at least 50 percent of its surface by the cap 66. Exterior to cap 66 is a high pressure burner 68 fed by compressor 69 with air extracted from the interior of the cap. The burner 68 provides high pressure hot gases of sufficiently low relative humidity for use in the dryer devices 72, four of which are shown. A conduit 70 leads from the burner to each dryer device 72, the free end of each conduit comprising a resilient mounting means 74 analogous to resilient means 20 of FIGS. 1 and 5. In fact, it might be found that an intermediate position of the resilient mounting means may permit the air exiting from the nozzles in devices 72 to assist in threading the sheet over the cylinder surface.

Dryer devices 72 are completely analogous to the apparatus 14 shown in FIG. 1 and need not be described in detail. It suffices to say that high velocity hot air issues from the nozzles in each foot section to float the foot portion on a wedge of fluid and to impinge on the paper sheet as it travels past. The jetting air cracks the boundary layer of moisture on the sheet due to the juxtaposition of the dryers from the sheet, in the range of, say $\frac{1}{8}$ to $\frac{1}{4}$ of an inch, and the high velocity air. Tests have shown with other impingement devices that 35 to 40 percent drying efficiency increases can be realized with jets moved from 1 inch to $\frac{1}{2}$ inch from dryer or web surfaces. Thus a more efficient drying system is achieved while at the same time there is a reduction in the power required over existing systems. The gap between the nozzles in existing air dryers and the sheet must be be fixed at some compromise clearance for air removal balance with turbulent and unorganized flows. This gap is extremely large in relation to the gap achievable with the present invention and this goes a long way to reducing the power required to achieve the desired degree of drying. In the present invention an optimum proximity can be achieved by automatic balance of the incoming nozzle hot gases impinging on the sheet with the required exhaust area required to release the hot air and vaporize moisture from the sheet. The organized flow of the angled jets will provide the best flow of hot gases with optimum removal conditions. Also, since the dryer cylinder is reduced in diameter due to repeated grinding the present invention automatically adjusts to the best new clearance position. It is also worthwhile noting that with the relatively high velocities of the nozzle jets as compared to the dryer surface speed, the nozzles need not necessarily be directed in one direction or the other with regard to the dryer rotation or web direction.

In the embodiment shown in FIG. 6 a doctor apparatus 76 is shown exterior of the dryer cap 66 to remove the dried paper from the cylinder. The doctor apparatus 76 could take the form shown in FIG. 4 or FIG. 5 or it could be custom designed to the particular operation. Other similar doctors could be used subsequent to doctor 76 to clean the cylinder surface of extraneous fibres or debris.

FIG. 7 shows a second dryer embodiment which utilizes the present invention in all of its modes of application, namely drying, sealing and doctoring. The dryer of FIG. 7 has an insulated vacuum hood 78 extending around more than 50 percent of the periphery of Yankee cylinder 10. At each end of the hood 78 a seal device 80 is resiliently mounted so as to direct pressurized hot gases or air against the paper sheet 40 at the entrance to the hood and at the exit of the hood thereby providing a dynamic non-wearing seal for the interior of the hood. Each seal device 80 is analogous to the basic apparatus 14 in that it rides on a wedge of pressurized air and it need not be further described since there is no difference in the air flow. As with the embodiment of FIG. 6 the present embodiment is provided with an air supported doctor device 76 which removes the dried sheet 40, from the cylinder 10.

Within the vacuum hood 78 is at least one, and preferably a plurality of, dryer devices 82 resiliently mounted so that a narrow gap diminishing in the direction of fluid projection is established between each foot portion and the paper sheet 40. No further discussion of the structure or mounting of devices 82 is required in view of previous discussions. Each device 82 is connected to a manifold 84 within hood 78 which acts as a source of relatively hot and dry high pressure air. The inlet of the manifold is sealed to the hood as at 86 and the outlet of the hood is sealed to conduit 88. Because of the sealing provided by seals 80 the only airflow within the hood 78 can be from manifold 84, through the nozzles in dryer devices 82 and hence through outlet conduit 88. Since the outlet conduit is connected to a vacuum/compressor pump 90 the interior of hood 78 can be maintained at a partial vacuum and hence the rate of evaporation from the paper sheet 40 can be considerably increased. Also, since the present apparatus works under partial vacuum conditions the temperatures of the hot air can be reduced from the temperatures required in an atmospheric system such as that shown in FIG. 6. In order to provide an essentially closed air system, showers 92 spray cooling water into the conduit 88 to initially cool the air in and hence remove moisture by condensation while providing the vacuum pump with sealing water and aid in the compression of the air. The compressed moist air from pump 90, heated somewhat by compression passes through separator 94 to remove the water droplets and then passes through heat exchanger 96 to heat and thus relatively dry it even further. Thus there will be very little air loss in the system and efficiencies will increase. It should be noted that gases heavier than air could be utilized to enchance drying by increased gas densities or improved properties.

FIG. 8 shows a third dryer configuration typical of many speciality or paper board dryer cylinder configurations except that in the present embodiment these dryers are enclosed to provide a system which is recirculatory, thereby resulting in enormous savings in energy. As with the previous embodiment the present embodiment uses low temperature air combined with a vacuum condition to achieve high dryer efficiencies. The paper sheet 40 is fed from the paper machine press section 60 around an input cylinder 98 at the entrance to the dryer. A pair of air supported seal devices, similar to devices 80 already described for the embodiment of FIG. 6, are provided. The dryer has a vacuum hood 102, interrupted only by the paper input at cylinder 98, the paper output at cylinder 104 (sealed by air-supported seal devices 100 as well) and the air outlet 106. The air outlet 106 is connected to conduit 108 which has cooling water spray 110 associated therewith and in turn is connected to vacuum/compressor pump 112. The moist air is compressed and fed to a separator 114 where the moisture (water) is removed. The compressed air is then fed to manifold 116 from which it is distributed to the seal devices 100 and the dryer devices 118 (distribution being schematically shown by the arrows leaving manifold 116).

As is shown in FIG. 8 the dryer devices are distributed about the portions of rolls 120 which support the paper sheet 40. As the sheet passes around a roll 120 it is subjected to high velocity impingement of air issuing from the dryer devices 118. With the air from the dryer devices being exhausted through vacuum/compressor pump 112 a partial vacuum is obtained within the dryer hood and evaporation of moisture from the paper sheet is enhanced. The fluid exhausted is cooled, dried, recompressed and recycled to the drier devices via manifold 116. Thus there is very little loss of fluid and the energy input is extremely small in comparison to existing dryers. After exitting the dryer hood around the exit cylinder 104 the sheet is fed to the reel section 122 where it is wound for subsequent finishing.

As can be seen from the examples of particular applications described herein the apparatus of the present invention is extremely versatile. It can be used to enchance the efficiency of regular dryers; it can be used to seal the inlet and exit ends of a vacuum dryer efficiently; it can be used to doctor a paper sheet from a rotating cylinder; it can be used in industries other than the paper industry for similar applications; and, in fact, it can perform multiple duty as, for example, a dryer and a seal device. This last function is performed of course by the two devices 100 which face the paper sheet, one at the inlet roll 98, the other at the outlet roll 104 (FIG. 8). The present invention therefore, while appearing to be relatively straight forward in basic structure, is capable of alleviating many problems associated with the paper industry, espcially at the dryer end of the paper machine and it does provide an additional new field of utilizing fluids heavier than air to provide energy savings unheard of at the present time where systems are limited to air.

The embodiments of the invention in which an exclusive property or privilege is claimed are defined as follows:

1. Apparatus for use in conjunction with a cylinder surface rotatable about an axis comprising a foot portion having an outer surface which substantially conforms to the curvature of the cylinder surface; means for resiliently supporting said apparatus in close juxtaposition to said cylinder surface whereby a gap of thickness diminishing progressively towards one longitudinal edge of said foot portion is formed between said outer surface and said cylinder surface; at least two rows of nozzles communicating through said foot portion to exit therefrom at said outer surface; and a source of pressurized fluid connectible to said nozzles, each of said nozzles having its axis directed obliquely to three orthogonal planes one of which is parallel to said one edge and another of which is tangent to said cylinder surface at the juncture of the nozzle axis with said cylinder surface whereby fluid which issues from the nozzles in the row farthest from said one edge will coact with fluid issuing from adjacent nozzles in the same and adjoining rows to create an organized flow of individual fluid streams.

2. Apparatus according to claim 1 wherein said nozzles are directed so that the fluid flow resulting from the coaction of fluid issuing from the nozzles in the row farthest from said one edge with fluid issuing from adjacent nozzles in the same and adjoining rows acts as a seal to preclude fluid from the remaining nozzles from passing thereby.

3. Apparatus according to claim 1 or claim 2 and including plenum means intermediary of said source and said plurality of nozzles for distributing pressurized fluid to said nozzles.

4. Apparatus according to claim 1 wherein said means for resiliently supporting said apparatus includes means for loading said apparatus and counterbalancing fluid pressures within said gap whereby said apparatus can be held in extremely close juxtaposition to said cylinder surface and thereby act as a doctor.

5. Apparatus according to claim 4 wherein said loading and counterbalancing means are variably adjustable along the length of said apparatus in order to achieve differential doctoring along said one edge.

6. Apparatus according to claim 4 or claim 5 and including a stepped portion in said outer surface of said foot portion adjacent said one edge; a removable blade member pivotally mounted in said stepped portion and extending to at least said one edge; and a row of additional nozzles communicating through said foot portion to exit therefrom between said blade member and the stepped portion of said outer surface, said additional nozzles being oriented similarly to said at least two rows of nozzles.

7. A dryer for drying a web of sheet material comprising a cylinder having a surface on which said web may be placed; a cap member extending around at least 50 percent of the surface area of said cylinder; and at least one fluid supported drying device comprising a foot portion having an outer surface which substantially conforms to the curvature of the cylinder surface; means for resiliently mounting said device within said cap member in close juxtaposition to said cylinder surface whereby a gap of thickness diminishing progressively towards one longitudinal edge of said foot portion is formed between said outer surface and said cylinder surface; at least two rows of nozzles communicating through said foot portion to exit therefrom at said outer surface; and a source of pressurized fluid connectible to said nozzles, each of said nozzles having its axis directed obliquely to three orthogonal planes one of which is parallel to said one edge and another of which is tangent to said cylinder surface at the juncture of the nozzle axis with said cylinder surface whereby fluid which issues from the nozzles in the row farthest from said one edge will coact with fluid issuing from adjacent nozzles in the same and adjoining rows to create an organized flow of individual fluid streams, the fluid streams being directed at high velocity so as to impinge against said web on said cylinder surface.

8. A dryer according to claim 7 and further including a seal device at the entrance and exit to said dryer, each said seal device comprising a foot portion having an outer surface which substantially conforms to the curvature of the cylinder surface; means for resiliently mounting said device in close juxtaposition to said cylinder surface whereby a gap of thickness diminishing progressively towards one longitudinal edge of said foot portion is formed between said outer surface and said cylinder surface; at least two rows of nozzles communicating through said foot portion to exit therefrom at said outer surface; and a source of pressurized fluid connectible to said nozzles, each of said nozzles having its axis directed obliquely to three orthogonal planes one of which is parallel to said one edge and another of which is tangent to said cylinder surface at the juncture of the nozzle axis with said cylinder surface whereby fluid which issues from the nozzles in the row farthest from said one edge will coact with fluid issuing from adjacent nozzles in the same and adjoining rows to create an organized flow of individual fluid streams; and means to exhaust the pressurized fluid exiting from said nozzles in the interior of the cap to form a partial vacuum therein.

9. A dryer according to claim 7 and further including a plurality of said cylinders for feeding said web therealong, each cylinder having a plurality of said fluid supported drying devices associated therewith; a feed cylinder at the entrance to said dryer; a feed cylinder at the exit from said dryer; a seal device positioned adjacent each of said feed cylinders each said seal device comprising a foot portion having an outer surface which substantially conforms to the curvature of the cylinder surface; means for resiliently mounting said device in close juxtaposition to said cylinder surface whereby a gap of thickness diminishing progressively towards one longitudinal edge of said foot portion is formed between said outer surface and said cylinder surface; at least two rows of nozzles communicating through said foot portion to exit therefrom at said outer surface; and a source of pressurized fluid connectible to said nozzles, each of said nozzles having its axis directed obliquely to three orthogonal planes one of which is parallel to said one edge and another of which is tangent to said cylinder surface at the juncture of the nozzle axis with said cylinder surface whereby fluid which issues from the nozzles in the row farthest from said one edge will coact with fluid issuing from adjacent nozzles in the same and adjoining rows to creat an organized flow of individual fluid streams; and means for exhausting the pressurized fluid exiting from said nozzles in the interior of said dryer to form a partial vacuum therein.

* * * * *